United States Patent [19]

Swietlik

[11] Patent Number: 4,572,305

[45] Date of Patent: Feb. 25, 1986

[54] DRILLING APPARATUS

[76] Inventor: George Swietlik, Sandings, Broad View Rd., Oulton Broad, Lowestoft, Suffolk, Great Britain

[21] Appl. No.: 583,947

[22] Filed: Feb. 27, 1984

[30] Foreign Application Priority Data

Jan. 27, 1983 [GB] United Kingdom ..... 8302270

[51] Int. Cl.[4] ..... E21B 7/10; E21B 17/10

[52] U.S. Cl. ..... 175/325; 175/73; 175/321

[58] Field of Search ..... 175/325, 321, 262, 230, 175/289, 287, 291, 73; 308/4 A; 166/241

[56] References Cited

U.S. PATENT DOCUMENTS

| | | | |
|---|---|---|---|
| 2,819,039 | 1/1958 | Lindsay et al. | 175/73 |
| 3,145,785 | 8/1964 | Kellner | 175/325 |
| 3,180,439 | 4/1965 | Deely | 175/325 |
| 3,370,657 | 2/1968 | Antle | 175/321 |
| 4,270,619 | 6/1981 | Base | 175/325 X |
| 4,388,974 | 6/1983 | Jones, Jr. et al. | 175/325 |
| 4,407,377 | 10/1983 | Russell | 175/325 |

*Primary Examiner*—James A. Leppink
*Assistant Examiner*—Hoang C. Dang
*Attorney, Agent, or Firm*—Ratner & Prestia

[57] ABSTRACT

A stabilizer for use in drilling and having its effective outside diameter adjustable by alteration of axial forces applied to the stabilizer during drilling.

5 Claims, 5 Drawing Figures

DRILLING APPARATUS

This invention relates to drilling apparatus.

In the technique of directional drilling, a number of subsurface targets are drilled at angles to the vertical so as to obtain access to a wide spread of wells from a single platform. Several problems are associated with directional drilling, for example the difficulty in keeping the borehole directed towards the target area, since in the majority of cases, the bottom hole assemblies used will tend to veer away either above or below the proposed drilling line and thus the inability to hold the intended deviation angle.

At the present time the drilling direction is adjusted by withdrawing the entire drill string from the borehole, replacing stabilisers on the string with stabilisers designed to effect drilling trajectory changes, and reinserting the string down the borehole. This can be extremely time-consuming and expensive, especially as directional drilling by its very nature is intended to provide a very long borehole from a remote point. Further, this operation has to be performed each time the drilling direction is to be adjusted.

In the past it has been necessary from time to time to withdraw the string from the borehole to replace the drill bit in view of the high degree of wear occurring at the bit, and advantage has been taken of these opportunities to adjust or replace the stabilisers in order to correct the drilling direction. Recently, however, much harder and more wear-resistant drill bits have been developed, for example those sold under the Trade Name STRATAPAX, and this has resulted in entire strings being withdrawn from the borehole and then replaced for the sole purpose of replacing the stabilisers; the drill bits now have the capability of being using for much longer periods without replacement.

An object of this invention is to provide a stabiliser which is adjustable downhole to provide an adjustment of the drilling trajectory.

According to the present invention there is provided a stabiliser for use in directional drilling, comprising a body having a side wall at least a portion of which is adjustable in its dimension normal to the intended drilling direction in response to the magnitude of a force applied to it in said intended drilling direction.

Preferably the stabiliser has one or more projections which are adjustable in their radial extent thereby to alter the effective diameter of the stabiliser. Such projections may for example be in the form of fins which project radially from the central body of the stabiliser.

Preferably also the projections form abutment members for engaging the wall of a borehole in use, and these abutment members are movable laterally of the body into and out of apertures in the side wall of the body.

In the case of cam control the stabiliser may have its body in two parts which are axially movable relative to one another under the effect of a force applied to the stabiliser in the drilling direction. The movement of the shaft may be against the action of a spring or other resilient means. The said parts of the body may be telescopically mounted, the opposite ends of the body having means for connection to respective parts of a drill string.

The invention also provides a drill string having spaced stabilisers for bearing against the wall of a borehole, wherein at least one of the stabilisers is generally cylindrical and is adjustable in its effective diameter in response to the magnitude of a force applied to it in the drilling direction.

The apparatus of the invention can be applied particularly effectively in combination on the drill string with STRATAPAX or other long-life drill bits, and mud-motors with off-set stabilisers as it may allow the drilling to continue, controlled in direction from the surface, without having to withdraw the string from the borehole for replacement or adjustment of the stabiliser before the drill bit has worn out.

Means may be provided for stepwise movement of the abutment members in response to a gradual change in the applied force, so that the shaft moves in quantum jumps reflecting specific intervals of increase or decrease in the applied force. Such an effect can be produced for example by providing rollers or other stop members on one of the parts of the stabiliser body engaging in spaced recesses along the other part of the body, the rollers being spring-biassed into the recesses.

The spring between the first and second parts of the stabiliser body may be a single unit capable of resisting the high working forces exerted on it, or may be a number of springs acting in conjunction.

An embodiment of this invention will now be described by way of example with reference to the accompanying drawings, in which:

FIG. 2(*b*) is an exploded perspective view of part of the assembly of FIG. 2(*a*);

Figure 1:
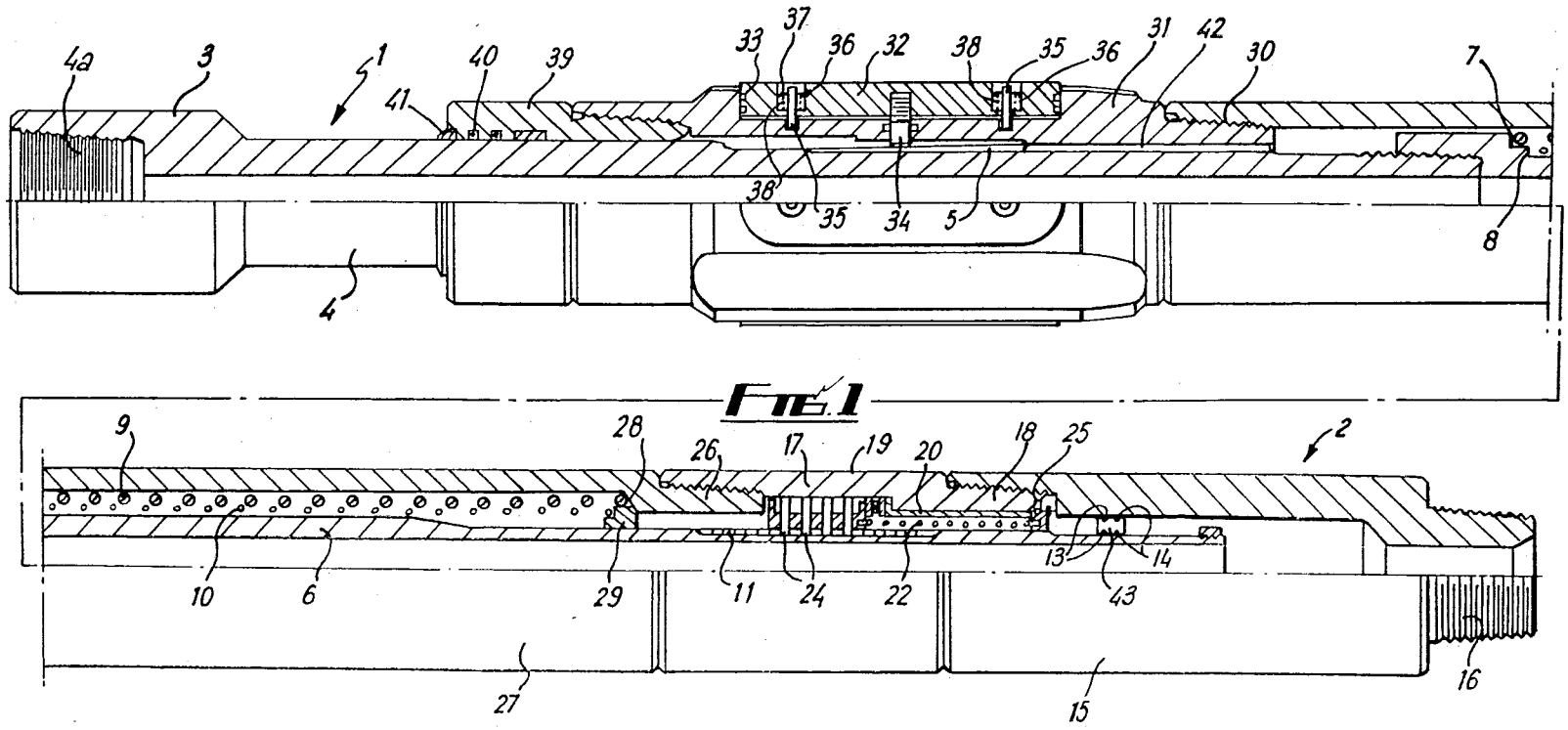
FIG. 1 is a side view, partly in section, of a stabiliser of the present invention.

Referring to the drawings, the stabiliser of this embodiment of the invention has a body which is in two main parts, namely first and second hollow cylindrical shaft assemblies 1 and 2. The assembly 1 comprises a shaft 4 having a pack-off end portion 3 which has a screw-threaded bore 4 for engagement with a complementary threaded end portion of part of a drill string (not shown) in which the stabiliser is disposed. The shaft 4 carries four fixed parallel projections 5 disposed at right-angles to one another around the shaft 4, these projections 5 all increasing in height along the shaft 4 so that their outer faces provide identically-inclined cam surfaces.

Figure 2B:
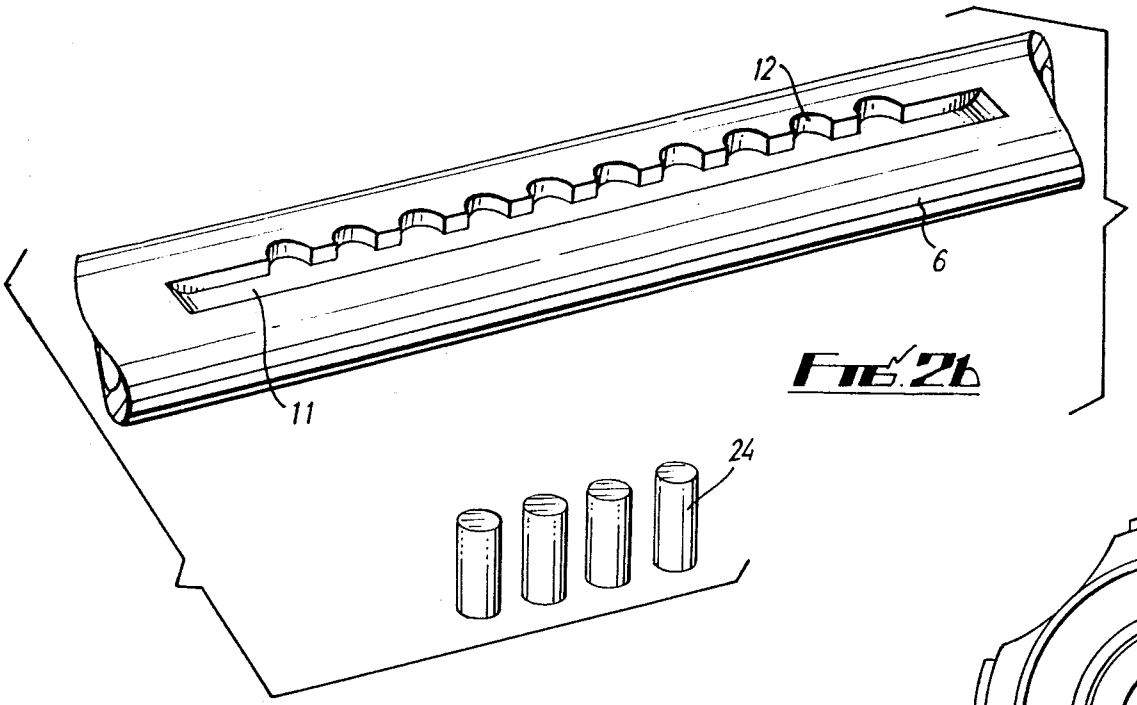
FIG. 2(*a*) is a side view of a preloading and stepwise transfer assembly of the stabiliser of FIG. 1.
Figure 4:
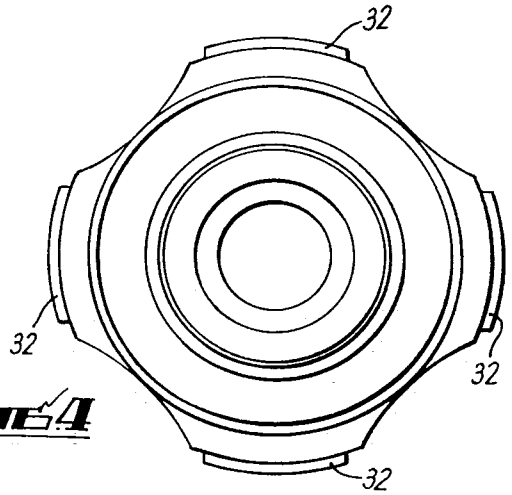
FIG. 4 is an end view of the stabiliser of FIG. 1.
Figures 2A, 3:
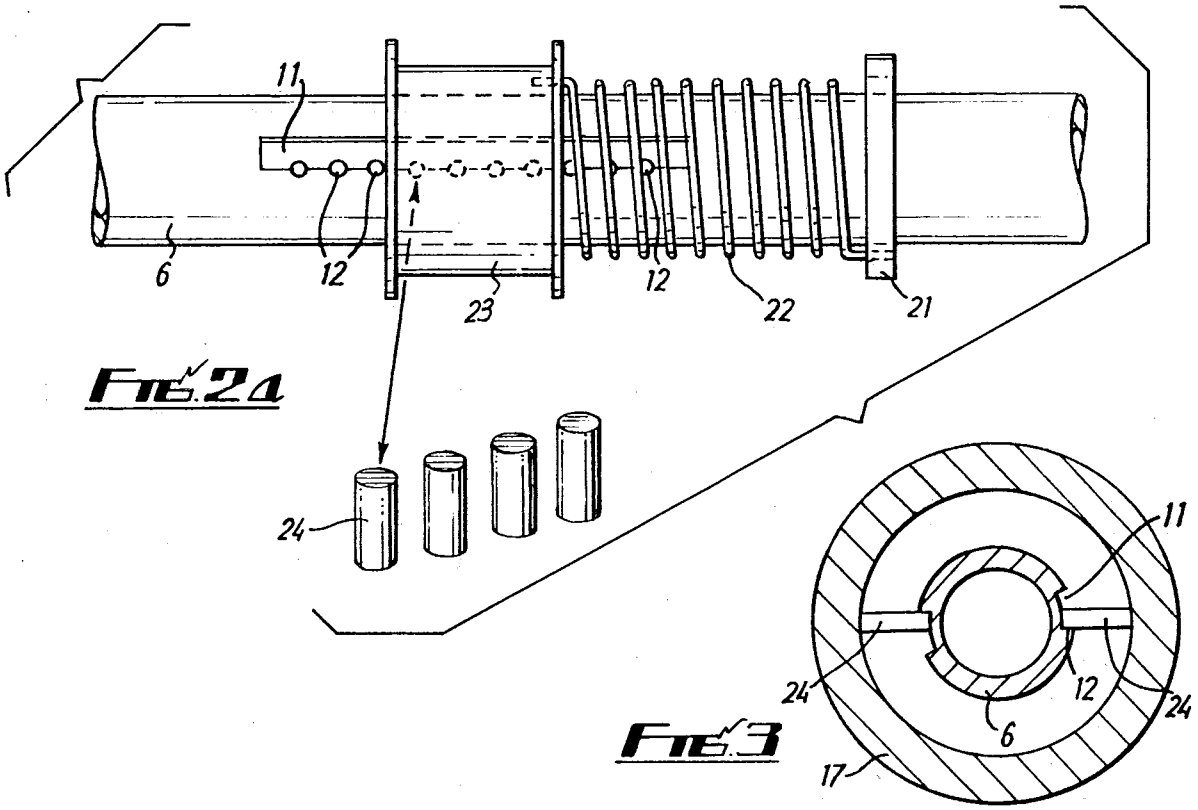
FIG. 3 is an end sectional view of the assembly of FIG. 2(*a*)

Screw-threaded onto the shaft 4 co-axially with it is a shaft 6 having a pair of stepped abutment faces 7,8 against which bear one end of respective compression springs 9,10, the spring 9 being of greater strength than the spring 10. (In other embodiments of the invention the compression springs 9,10 can be replaced by disc springs). The shaft 6 has longitudinal recesses 11 diametrically opposed in its outer face, one of the recesses 11 being shown in more detail in FIG. 2(*b*). Each of the recesses 11 has a side wall which has ten semi-circular cut-outs 12 equally spaced along it.

A fully-floating piston 43 is disposed in the bore of the body and onto the shaft assembly 2 to allow for equilibrium of pressure between the internal workings and the external environment. The piston 43 has a set of circumferential grooves 13 in which O-rings seals 14 are located, the O-rings 14 providing seals between the piston 43 and a shaft 15 of the assembly 2 disposed co-axially around it.

The free end of the shaft 15 is externally screw-threaded at 16 to provide means for connection to a complementary threaded bore of a part of a drill-string in which the stabiliser is to be disposed in use. The shaft 15 is screwed to one end of a short housing 17 forming part of the assembly 2, the housing 17 being generally cylindrical and having a stepped inner face providing a portion of smaller internal diameter 18 and a portion of larger internal diameter 19. A cylindrical liner 20 extends along the smaller diameter portion 18, terminating at one end by abutment against a preload setting ring 21 (see FIG. 2(*a*)) keyed or otherwise fixed against rotation on the external surface of the housing 17 and having an aperture which receives and anchors one end of a torsion spring 22 extending around the housing 17. The opposite end of the spring 22 is anchored on a cylindrical roller support 23 which carries four rollers 24. The support 23 is biassed by the spring 22 in such manner that the rollers 24 are held in engagement with four of the cut-outs 12 of the shaft 6, thereby preventing relative axial movement of the shaft assemblies 1 and 2 until the force of the spring 22 is overcome.

The preload setting ring 21 can be adjusted by means of selectors 25 to alter the force exerted by the spring 22 on the roller support 23.

The housing 17 is secured through a screw connection 26 to a shaft 27 having on its inner face a shoulder 28 against which the spring 9 bears. Th spring 10 bears against an abutment 29. At its other end the shaft 27 is screwed at 30 to a further cylindrical housing 31 which is recessed at four locations around its outer wall to receive slidable fins 32 sealed against the wall of the housing 31 by O-rings 33. Passing through an aperture in the housing wall and screwed into each fin 32 is a cam follower 34 whose free-end bears against the cam surface of the corresponding projections 5.

A pair of posts 35 are secured within the wall of the housings 31 and extend into corresponding recesses 36 in the fins 32. The posts 35 carry collars 37 against which bear compression springs 38 biassing the fins 32 and thereby cam followers 34 inwardly of the housing 31 against the projections 5. Fins 32 and cam followers 34 therefore form bearing members biased inwardly by springs 38.

The housing 31 and the shaft 4 are held against relative rotational movement by splines 42 around their mating faces, while relative axial movement remains possible.

A sleeve 39 is screwed to the housing 31 and a seal is formed between it and the shaft 4 by O-rings 40. Low-friction bearing pieces 41 are also provided between the sleeve 39 and shaft 4.

In use, the stabiliser of this embodiment of the invention is screwed into a drill string by means of the bore 4 and screw-thread 16 at a distance from the drill bit, and rotational drive is transferred to the drill bit through the stabiliser from the shaft assembly 1 to the shaft assembly 2 through the splines 42. During drilling an axial force is also applied to the drill bit through the stabiliser, and this axial force can be increased or decreased as desired.

An increase or decrease in the axial force to which the stabiliser is subjected tends to cause the shaft assembly 1 to slide within the assembly 2 reducing or increasing telescopically the overall length of the stabiliser, and this movement causes the cam followers 34 to move along the cam surfaces of the projections 5, resulting in lateral extension or retraction of the fins 32. In this way an alteration in the applied axial force to the stabiliser produces an alteration in the effective diameter of the stabiliser body across the surfaces of the fins. As the fins 32 extend further outwards they engage more readily the side walls of the borehole in which the drill string is located, lessening the degree of curvature of the string. Retraction of the fins 32 reduces the overall diameter of the stabiliser and allows greater curvature of the string in the borehole. The direction of deviation of the drill bit can thus be controlled by applying a greater or lesser force to the string at the surface, the effect of this force being to control the diameter of the stabiliser.

Thus if the drill bit is found to be acting below the desired line of drilling the axial force applied to the string from the surface is increased, causing the shaft assembly 1 to move to the right relative to the assembly 2, with the result that the cam follower 34 engages a portion of the cam surfaces of lesser height, thus causing the fins 32 to retract. The curvature of the drill string therefore increases, forcing the drill bit upwards, as the stabiliser's effective diameter decreases.

Similarly the curvature of the string can be reduced, with consequent dropping of the drill bit, by reducing the axial force on the stabiliser, with resulting increase in the projection of the fins 32 from the wall of the stabiliser.

Stepwise transfer of alterations in the applied force to the stabiliser diameter is achieved by means of the roller arrangement between the housing 17 and shaft 6. As the applied force increases but is insufficient to overcome the force exerted by the torsion spring 22, axial movement of the shaft assembly 1 relative to the assembly 2 is prevented by the rollers or stop members 24 engaging in the cut-outs 12. Increase of the applied force to a level sufficient to overcome the effect of the torsion spring 22 causes the rollers 24 to leave the cut-outs 12 and the shaft assembly 1 to move within the assembly 2 until the rollers 24 engage in the next adjacent cut-outs 12, again locking the shaft assemblies against further movement. Incremental movement of the shaft assemblies 1,2 is thus provided in response to predetermined levels of increase or decrease in the axial force applied to the stabiliser. As a result, the fins 32 extend and retract in stepwise fashion also.

Modifications and improvements may also be made without departing from the scope of the invention.

I claim:

1. A telescopically-expandible tubular stabiliser for use in directional drilling comprising upper and lower connection means for connecting the stabiliser into a drill string an elongate fluid-conducting body having one of said upper and lower connection means an elongate fluid-conducting mandrel telescopically slidable within the body and splined to the body, the mandrel having the other of said upper and lower connection means, the mandrel being spring-urged out of the body means defining apertures in a side wall of the body and spaced around the body radially-movable bearing members, a portion of said bearing members disposed in said apertures spring means uging said bearing members into the body cam means on the mandrel in engagement with said portion of said bearing members to move the bearing members radially outwardly of the body against the action of said spring means on telescopic withdrawal of the mandrel from the body in response to a reduction in the magnitude of a force applied to it in the intended drilling direction.

2. A stabiliser according to claim 1, wherein the cam means comprises a radially-inclined surface on the mandrel which increases in height axially of the mandrel in a direction into the body.

3. A telescopically-expandible tubular stabiliser for use in directional drilling comprising upper and lower connection means for connecting the stabiliser into a drill string an elongate fluid-conducting body having one of said upper and lower connection means an elongate fluid-conducting mandrel telescopically slidable within the body and splined to the body, the mandrel having the other of said upper and lower connection means, the mandrel being spring-urged out of the body means defining apertures in a side wall of the body and spaced around the body radially-movable bearing members, a portion of said bearing members disposed in said apertures spring means urging said bearing members into the body cam means on the mandrel in engagement with said portion of said bearing members to move the bearing members radially outwardly of the body against the action of said spring means on telescopic withdrawal of the mandrel from the body a detent mechanism providing incremental axial movement of the mandrel relative to the body, the detent mechanism comprising a stop member axially held on the body means defining axially-spaced recesses on the mandrel, the stop member selectively engaging with said recesses and torsion spring means on the mandrel urging said stop member into said recesses, the recesses each being of symmetrical profile about an axis lateral of the mandrel so that application of an axial force to the mandrel in a direction into or out of the body and of a magnitude sufficient to overcome the effect of the torsion spring means causes the stop member to come out of engagement with one of the recesses and travel to another of the recesses upon corresponding travel of the mandrel within the body.

4. A stabiliser according to claim 3, wherein a plurality of said stop members are provided, the stop members having the same axial spacing as the recesses so that the stop members engage simultaneously in the recesses.

5. A stabiliser according to claim 3, wherein the recesses are part-circular in profile and the stop member is in the form of a cylindrical roller.

* * * * *